US008351575B2

(12) United States Patent
Vogtmeier

(10) Patent No.: US 8,351,575 B2
(45) Date of Patent: Jan. 8, 2013

(54) MULTIPLE ENERGY X-RAY SOURCE

(75) Inventor: Gereon Vogtmeier, Aachen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 262 days.

(21) Appl. No.: 12/866,745

(22) PCT Filed: Feb. 10, 2009

(86) PCT No.: PCT/IB2009/050542

§ 371 (c)(1),
(2), (4) Date: Aug. 9, 2010

(87) PCT Pub. No.: WO2009/101576

PCT Pub. Date: Aug. 20, 2009

(65) Prior Publication Data

US 2011/0007874 A1 Jan. 13, 2011

(30) Foreign Application Priority Data

Feb. 15, 2008 (EP) ..... 08101670

(51) Int. Cl.
*H01J 35/00* (2006.01)

(52) U.S. Cl. ..... 378/122; 378/136

(58) Field of Classification Search ..... 378/122, 378/119, 136
See application file for complete search history.

(56) References Cited

U.S. PATENT DOCUMENTS

| | | | | |
|---|---|---|---|---|
| 2,900,542 | A | 8/1959 | Mceuen | |
| 6,125,168 | A | 9/2000 | Bhatt | |
| 6,333,968 | B1 * | 12/2001 | Whitlock et al. | 378/136 |
| 2002/0094064 | A1 | 7/2002 | Zhou et al. | |
| 2003/0142790 | A1 * | 7/2003 | Zhou et al. | 378/119 |
| 2005/0100132 | A1 | 5/2005 | Block et al. | |

FOREIGN PATENT DOCUMENTS

| | | |
|---|---|---|
| JP | 2000340149 | 12/2000 |
| WO | 2006130630 | 12/2006 |
| WO | 2007142999 A2 | 12/2007 |

* cited by examiner

*Primary Examiner* — Hoon Song

(57) ABSTRACT

A source (19) for multiple energy X-ray generation in particular by field emitting carbon nanotubes (1, 2) is presented. In order to achieve a spatial overlap of the trajectories of the X-ray beams coming from different emitters, a focusing unit (7, 9) is supplied to the emitted electrons (28, 29). A fast switching between the emission of the different carbon nanotubes allows multiple kilovolt imaging. Independent determination of multiple focal spot parameters by the focusing unit leads to the possibilities of fast switching between different spot geometries and spatial resolutions. This might be seen in FIG. 1.

12 Claims, 5 Drawing Sheets

MULTIPLE ENERGY X-RAY SOURCE

FIELD OF THE INVENTION

The present invention relates to the field of X-ray generation. More specifically the invention relates to a source for generating X-rays of multiple energy, an examination apparatus, a method as well as software elements and a computer readable medium.

BACKGROUND OF THE INVENTION

In many applications of imaging X-rays are used to examine and analyze the structure and material properties of multiple objects like human bodies, organs, tissues or crystal structures. One of the basic areas of health care in which X-radiation is used is radiography. Radiography may be used for fast, highly penetrating images in particular for regions with a high bone content. Some forms of radiography use are panoramic X-rays, mammography, tomography and radiotherapy.

For computed tomography (CT) for example, patients are illuminated by beforehand generated X-rays from various positions and angles, in order to reconstruct a three dimensional (3D) model of the analyzed anatomical structure. Using for example a CT, the object of interest may be exposed to the radiation from 360 degrees and a model of the object of interest may be computed from so called projection images. As a time deviation between the origins of the different pictures is unavoidable for moving objects, motion artifacts of the reconstructed model are still a challenging task.

Conventional X-ray sources are heated cathode filaments which thermally emit electrons. The electrons are accelerated as a beam and then strike a target material, where subsequently X-rays are generated. The point where the electron beam strikes the angled target or anode is called the focal spot. Most of the kinetic energy contained in the electron beam is converted into heat, but a certain amount of the energy is converted into X-ray photons. At the focal spot, X-ray photons are emitted. Thereby a heating up of the electron absorbing target up to the melting point of the used material often limits the intensity of the generated X-ray beam of known X-ray sources.

SUMMARY OF THE INVENTION

It may be desirable to provide for a fast and efficient X-ray generation for examining an object of interest.

This object may be realized by the subject-matter according to one of the independent claims. Advantageous embodiments of the present invention are described in the dependent claims.

The described embodiments similarly pertain to the radiation source, the examination apparatus, the method for X-ray generation, the computer program element and the computer readable medium.

According to a first exemplary embodiment of the present invention, a radiation source for X-ray generation for examining an object of interest is provided. Thereby the source comprises a first carbon nanotube for emitting first electrons and a second carbon nanotube for emitting second electrons and further comprises a target. Further on, a focusing unit for focusing the first and the second electrons onto the target to generate first X-ray photons having a first trajectory and second X-ray photons having a second trajectory is comprised. The focusing unit is adapted for being operated in such a way, that the first and the second trajectories overlap before reaching the object of interest.

It should be noted that instead of using the terms a first carbon nanotube and a second carbon nanotube, it is also possible to use a first group of carbon nanotubes and a second group of carbon nanotubes or a first carbon nanotube based emitter and a second carbon nanotube based emitter in this or any other embodiment of the invention. A "group" of cnts may be a bunch, bundle, pack and a bale. All possible cnt configurations may be located on a substrate or carrier.

In the following three different types of voltages may be important. The three types are: gate voltages, acceleration voltages and focusing voltages. Thereby a for example first gate voltage may be applied between a first substrate or a first carbon nanotube on the substrate and first gate. A first accelerating voltage may be applied between a first substrate or a first carbon nanotube on the substrate and a target. Further on, a for example first focusing voltage may be applied between a first substrate or a first carbon nanotube on the substrate and between a part of a first focusing unit. It shall further be noted that all different types of voltages and different voltage sources of the same type may be adjusted independently from each other.

As an acceleration voltage may determine the energy of the accelerated electrons it shall further be noted, that an acceleration voltage may determine the energy of the generated X-ray photons. On the other hand the focusing voltage may determine the focal spot size, which is the area where the electrons hit the target. Hence the beam parameters of the X-ray photons and therefore the spatial resolution may be determined by the focusing voltage.

For example two independent gate voltages are applyable to the cnts, wherein the cnts operate as cathodes. Through this set up, electrons are emitted by the cnts via the so called process of field emission. In doing so the volume of a gate voltage may control the intensity of the electron beam and therefore the intensity of a generated X-ray beam. For example one voltage supply may be switched between the cnts to apply both gate voltages alternately. Both possible switching modi may be carried out at a high frequency, as the frequency of switching may be not limited by the cnts.

By using this special configuration of carbon, the carbon nanotubes, as an electron emitter, it may be possible to profit from the fact, that the cathodes (which are the cnts) do not have to be thermally heated to emit the electrons, as the emission is realized via field emission. Therefore no afterglow is present in the cnts and a fast, exact and in consideration of time an absolutely controllable switch on and off of the electron emission process may be possible. Due to the fact, that the electrons can be accelerated and focused independently they may generate X-ray photons with different energies and different propagation parameters like the beam diameter or the divergence of each respective generated X-ray beam. This may allow a fast switching between an emission of energetically different X-ray photons with independent beam parameters, wherein there is no overlap in time of the two different emission processes. It should be noted, that although the beam parameters of each X-ray beam geometry are independent from the parameters of another beam, both beam parameters may be adjusted to the same size.

The target may be formed in different geometrical forms and out of standard X-ray source material like molybdenum, tungsten, copper or different compositions of these or other elements. Possible geometries of the anode include triangular, pyramidal, circular, elliptical or cubical. Furthermore it is possible, that a carrier element comprises several different areas or elements, that consist of a target material.

By using the focusing unit, which might for example be a focusing electrode, electrical fields are generated to deviate the electrons, that are accelerated by the acceleration voltages onto the target. But also several electrodes may be used for focusing the electrons, for which several different and independent focusing voltages may be applied. Thereby the deviation of the electrons may be controlled in such a way, that the focal spot on the target or anode can be varied in it's parameters like for example size and geometry. As a small focal spot size (which corresponds to a focusing of the electrons onto a small spot) may lead to a spatially small or narrow emitted X-ray beam, a high spatial resolution may be achieved with these X-ray photons and hence with this focusing set up. Contrariwise a big focal spot size may lead to a wide emitted X-ray beam, and hence a small spatial resolution can be obtained.

Another aspect of the focusing unit is the adjustability of the focus geometry. It may for example be interesting to generate a circular focal spot or for example an elliptical shaped spot. Other geometries may be adjusted by the user via the focusing electrodes or focusing electrical fields.

In other words, by switching between the two different X-ray generating entities, it may be possible to switch between different spatial resolutions and/or between different spot geometries of the two different entities.

Further on, through the configuration of the focusing unit, the trajectory of the first group of X-ray photons, emitted by the first cnt, may be deviated in such a way, that it is brought to a complete and exact spatial overlap with the trajectory of the second group of X-ray photons, emitted by the second cnt, before the photons reach the spatial coordinates of the object of interest. This means, that the spatial difference of the two beams of the two different X-ray generating areas of the target may be that small at the object of interest, that a possible and following reconstruction may lead to a result, that, in consideration of artifacts, may be compared with a measurement of two X-ray beams coming from the same source.

In other words, at the position of the object of interest the trajectories of the first and second X-ray photons may not be distinguishable from each other, as they were brought to a spatial overlap by the focusing unit before reaching this position. This corresponds to the situation in which the two different types of photons seem to have the same source position.

Further on, a voltage compensation and mechanically modified or adapted electrodes may be adapted in such a way, that a beam deviation between the two different beams is avoided.

After having passed the object of interest, the X-ray photons may be detected by an adequate detector and so called projection images may be generated by, for example, a working station or an imaging system.

Thereby an imaging system may for example be an X-ray apparatus, a CT, micro CT, a combination of a positron emission tomography apparatus (PET) with a X-ray device, a single photon emission ct (SPECT) in combination with a X-ray device or a combination of an X-ray apparatus with an magnetic resonance imaging apparatus (MR) or ultrasound system.

This aspect of the invention may lead to the fact, that for reconstruction of a model of an examined object through projection images all X-ray photons of this X-ray source do have the same source position. An advantage of this embodiment of the invention may therefore be an exact reconstruction that is based on dual or multiple energy X-ray photons without motion artifacts.

In other words, instead of measuring the energy- or wavelength specific transmission signal by, for example an energy, resolving detector, it may be possible due to this embodiment of the invention to alternately illuminate the object very fast with dual or multiple energy X-ray photons that have the same trajectory. By knowing at which time which energy type of photons has been used, the reconstructions may lead to sharper, higher resolved images with less motional artifacts and the use of an energy resolving detector may be avoided.

In other words, as motion artifacts may be avoided by this invention, this may lower the physical impact to a patient, which impact is applied through diagnostic examination, in which the X-radiation must be used. Additional image generation in accordance with X-ray exposure may be avoided. Further on, potential operational costs may be reduced as the carbon nanotube emitters also may use less energy than conventional X-ray tubes and may allow smaller system designs.

Another aspect of this embodiment may be to use the switching between the two entities for avoiding a heating up of the target. By applying totally equal conditions for the upper entity and the lower entity (compare FIG. 1) and by realizing the overlap, it may be possible to avoid a melting of the target and an increase in electron and X-ray intensity. It may be another possibility, that the target rotates around specific axis to amplify this cooling effect. Therefore, a faster examination with higher intensities compared to known sources may be provided.

Thereby this aspect of the invention is not about providing a diagnosis or about treating patients, but about a solution of the technical problem to fast provide for X-ray photons with different energies, but having the same trajectory to the object of interest.

According to another embodiment of the present invention the focusing unit comprises two focusing sub units; wherein the first sub unit is adapted for focusing the first electrons onto the target and the second sub unit is adapted for focusing the second electrons onto the target.

Each of the two sub units may be part of an independent unit for generating X-ray photons. This exemplary embodiment of the invention may increase the independence of the two X-ray generating processes. The set ups for deviating and focusing the emitted electrons concerning spatial resolution, spot size, spot geometry and trajectories of the X-ray photons may therefore be adjusted in such a way, that the desired examination of an object of interest may be done in a very fast, very exact and efficient way. Motion artifacts may further be avoided.

In other words, by selecting two specific set ups for the two focusing units, the overlap of the two different types of X-ray photons may be optimized. Subsequently, the on and off switching between the two independent cnt emitters with different accelerating voltages leads to dual energy X-ray generation and a fast emission on the same trajectory.

According to another embodiment of the present invention, the radiation source is adapted for switching between different focus geometries of the first and the second X-ray photons.

By using for example two different focusing units for the respective emitted electrons, the parameters of the area at which the electrons strike the target may be adjusted. Therefore the spatial resolutions of electron emitting part of the radiation source may be adjusted independently. Further on, for examining special objects of interest with varying material properties, it may be advantageous to fast examine the object with two X-ray beams, that differ in their wavelength, in order to resolve or separate different materials. This might be realized by different acceleration voltages.

Resolving ambiguities like kissing vessels or complex vascular structure or overlapping body elements or very dense organ regions may therefore be eased and the operational cost, time and the needed energy may be decreased.

According to another embodiment of the present invention, the radiation source is adapted for switching between different energies of the first and the second X-ray photons.

By for example applying different acceleration voltages to the first and second carbon nanotube it is possible to generate dual energy X-ray photons. By switching between the emission of for example the upper emission unit and the lower emission unit of FIG. 1, a fast dual energy switching may be provided. Therefore the necessary amount of independent acceleration voltage supplies for each emission unit may be comprised in this or another embodiment of the invention, and may be part of for example an examination apparatus that further comprises such a radiation source.

According to another embodiment of the present invention, the radiation source is adapted for modulating a spatial resolution of the first and the second X-ray photons.

The focusing units may be used to adjust different focus- or focal-geometries. This may cause a different spatial resolution of the first and the second X-ray photons by the following process. A small focal spot size may lead to a spatially small or narrow emitted X-ray beam and a high spatial resolution may be achieved with these X-ray photons. Contrariwise a big focal spot size may lead to a wide emitted X-ray beam, and hence a small spatial resolution may be obtained.

As objects of interest may differ in their structural complexity and material density, different spatial resolutions may lead to an improved information of the object of interest. Exposing a certain area of the object of interest alternately to different X-ray beams with different spatial resolutions in a very fast switching way, the spectrum of information that is gathered during the examination may therefore be increased.

According to another embodiment of the present invention, the radiation source further comprises a housing, wherein the first carbon nanotube, the second carbon nanotube and the focusing unit are integrated in the housing.

According to another embodiment of the present invention, the radiation source further comprises a housing, wherein the first carbon nanotube, the second carbon nanotube, the focusing unit and the target are integrated in the housing.

This solution for fast switching cnt X-ray source integrates the two cnt elements in one housing with an adapted optimized focusing to the same object. The integration with the focusing unit in a small volume may be an aspect of this embodiment, that may enable for very fast dual kilovolts (kV) imaging. This may make the radiation source easily integrable in for example existing imaging systems like a X-ray apparatus, a CT or a structure analyzing device.

As may, for example, seen from FIG. 1, the housing further protects the inner elements mechanically from possible damage.

According to another embodiment of the present invention, the radiation source further comprises a plurality of carbon nanotubes, wherein each carbon nanotube is adapted for emitting electrons and wherein all carbon nanotube are located in a geometry around the target. Further on, the focusing unit is adapted for focusing the emitted electrons of each carbon nanotube onto the target to generate corresponding X-ray photons with respective trajectories. The focusing unit is further adapted for being operated in such a way, that all trajectories overlap before reaching the object of interest.

Thereby the carbon nanotubes may also be used as carbon nanotube based emitters, that may consist of several different types of carbon nanotubes, like single wall carbon nanotubes, multi wall carbon nanotubes, cnt that are metallic or cnt that are semiconducting.

The geometry of the located cnts may, for example, be circular. But also a cubical arrangement of the cnts around the target, as may be seen, for example, from FIG. 2 is possible.

In other words, by continuously filling up the positions along an arbitrary circumference around the target, the user may be enabled to generate X-ray photons that continuously cover an desired energy spectrum. This may increase the total resolution of the radiation source and may lead to a fast and efficient examination process with a more specific generated data set reflecting the properties of the object of interest.

Thereby the shape of the target may be adapted to the amount of used cnts as different electron sources. Using for example four cnts, a pyramidal geometry may be a possible configuration of the target. Thereby the four equivalent surfaces may be illuminated with the respective electrons of the first, the second, the third and the fourth cnt.

Using a continuum of cnts in a circular formation, a cone geometry of the target or a circular shaped carrier with single targets may be a further possible solution.

For example, an array of these emitters can be placed around a target to be scanned and the images from each emitter can be assembled by a computer with the help of a computer software to provide a 3 dimensional image of the object of interest in a fraction of the time it may take using a conventional X-ray device.

According to another embodiment of the present invention an examination apparatus for the examination of an object of interest is provided, wherein the examination apparatus comprises a radiation source as described above.

As X-rays are used in various fields of analyzing matter like nondestructive material testing, X-ray crystallography, or broad fields of medical examinations like radiography, mammography, CT and others, but also new applications like quality control in food processing industries, different examination apparatuses may profit from the invention.

Especially for analyzing complex and dynamic objects with an examination apparatus the above and in the following described radiation source may offer a fast and efficient dual or multiple kV and therefore dual or multiple energy imaging.

According to another embodiment of the present invention, the examination apparatus further comprises a first and a second voltage supply, wherein the first voltage supply is arranged to apply a first acceleration voltage to the first carbon nanotube and the second voltage supply is arranged to apply a second acceleration voltage to the second carbon nanotube. Furthermore, a difference between the first and the second acceleration voltage leads to a difference of energy between the first and the second X-ray photons.

As the acceleration voltage determines the energy of the accelerated electrons, the energy of the generated X-ray photons may be determined by the acceleration voltage.

In order to enable field emission of electrons out of the emitters, gate voltages are applied. The focusing unit further controls the deviation of the electrons via a focusing voltage.

Switching between these two (different electron emitters with different acceleration voltages may lead to an alternating emission of energetically different X-ray photons for examination of the object of interest. These two voltage supplies may further be integrated in the one housing.

Further on, the examination apparatus may comprise additionally or instead of the acceleration voltage supplies other independent voltage supplies for each emission unit like gate voltage supplies or focusing voltage supplies.

According to another exemplary embodiment of the present invention a method for X-ray generation for examination of an object of interest is provided, the method comprising the steps of providing a first and a second modus and switching between the first and the second modus, wherein the first modus comprises focusing first electrons emitted by a first carbon nanotube onto a target to generate first X-ray photons having a first trajectory. The second modus comprises focusing second electrons emitted by a second carbon nanotube onto a target to generate second X-ray photons having a second trajectory, wherein the focusing is performed in such a way, that the first and the second trajectories overlap before reaching the object of interest.

By a fast switching between the two modi, the method may enable the user to analyze and examine objects in a fast and efficient way, as additional information about the material and structural properties of the object may be gathered. This may be realized by overlapping different X-ray beams, that have their origin in different electron emitters. As the X-rays from different emitters may have different energies, a dual, trial or multiple energy imaging is provided by this exemplary embodiment of the invention.

A user like, for example, a physician may induce the steps of the method while analyzing for example a patient. Thereby this aspect of the invention is not about providing a diagnosis or about treating patients, but about a solution of the technical problem to fast provide for X-ray photons with different energies, but having the same trajectory to the object of interest.

According to another embodiment of the present invention, the method comprises the steps of selecting a first acceleration voltage and a second acceleration voltage by a user or a software based computer system and selecting a frequency of the switching between the first and the second modus by a user or a software based computer system, wherein the first acceleration voltage is applied to the first carbon nanotube and the second acceleration voltage is applied to the second carbon nanotube.

It shall further be noted that the steps of this and other embodiments of the invention do not necessarily need an interaction with a potential patient.

According to another embodiment of the present invention, a computer program element is presented which computer element is characterized by being adapted, when in use on a general purpose computer, to cause the computer to perform the steps of the method described.

The computer element may further be characterized by being adapted, when in use on a general purpose computer, to cause the computer to perform the temporal control of the system including the switching of or the switching between the cnts.

This computer program element may therefore be stored on a computing unit, which may also be part of an embodiment of the present invention. This computing unit may be adapted to perform or induce the performing of the steps of the method described above. Moreover, it may be adapted to operate the components of the above described-apparatus. The computing unit can be adapted to operate automatically and/or to execute the orders of a user. Furthermore, the computing unit can request the selection from a user to process the input from the user.

As for example can be seen in FIG. 5, a computing unit, with a computer program element on it, is adapted for controlling the imaging process of an X-ray apparatus, that uses a radiation source according to another exemplary embodiment of the invention. Further on, a computer-readable medium is shown, wherein the computer-readable medium has a computer program element stored on it. That computer-readable medium might for example be a stick, that might be plugged into a computer system, to enable this system to control an imaging system like the shown X-ray apparatus with an radiation source according to another exemplary embodiment of the invention.

This embodiment of the invention covers both a computer program, that right from the beginning uses the invention, and a computer program, that by means of an update turns an existing program into a program that uses the invention.

Further on, the computer program element may be able to provide all necessary steps to fulfil the method of X-ray generation as described with respect to in the method and apparatus above.

According to a further exemplary embodiment of the present invention, a computer-readable medium is presented wherein the computer-readable medium has a computer program element stored on it, which computer program element is described by the preceding or following sections.

Further on, another exemplary embodiment of the present invention may be a medium for making a computer program element available for downloading, which computer program element is adapted to perform the method according to one of the above embodiments.

It may be seen as a gist of the invention, that two types of X-ray photons with different energies are generated with the help of cnts during an alternating, very fast switching between two generation modi, wherein the trajectories of the two types of X-ray photons are forced to overlap each other by a focusing unit before reaching an object of interest.

It has to be noted that some of the embodiments of the invention are described with reference to different subject-matters. In particular, some embodiments are described with reference to method type claims whereas other embodiments are described with reference to apparatus type claims. However, a person skilled in the art will gather from the above and the following description that unless other notified in addition to any combination of features belonging to one type of subject-matter also any combination of features relating to different subject-matters is considered to be disclosed with this application.

The aspects defined above and further aspects, features and advantages of the present invention can also be derived from the examples of embodiments to be described hereinafter. The invention will be described in more detail hereinafter with reference to the following drawings.

DETAILED DESCRIPTION OF EMBODIMENTS

Figure 1:
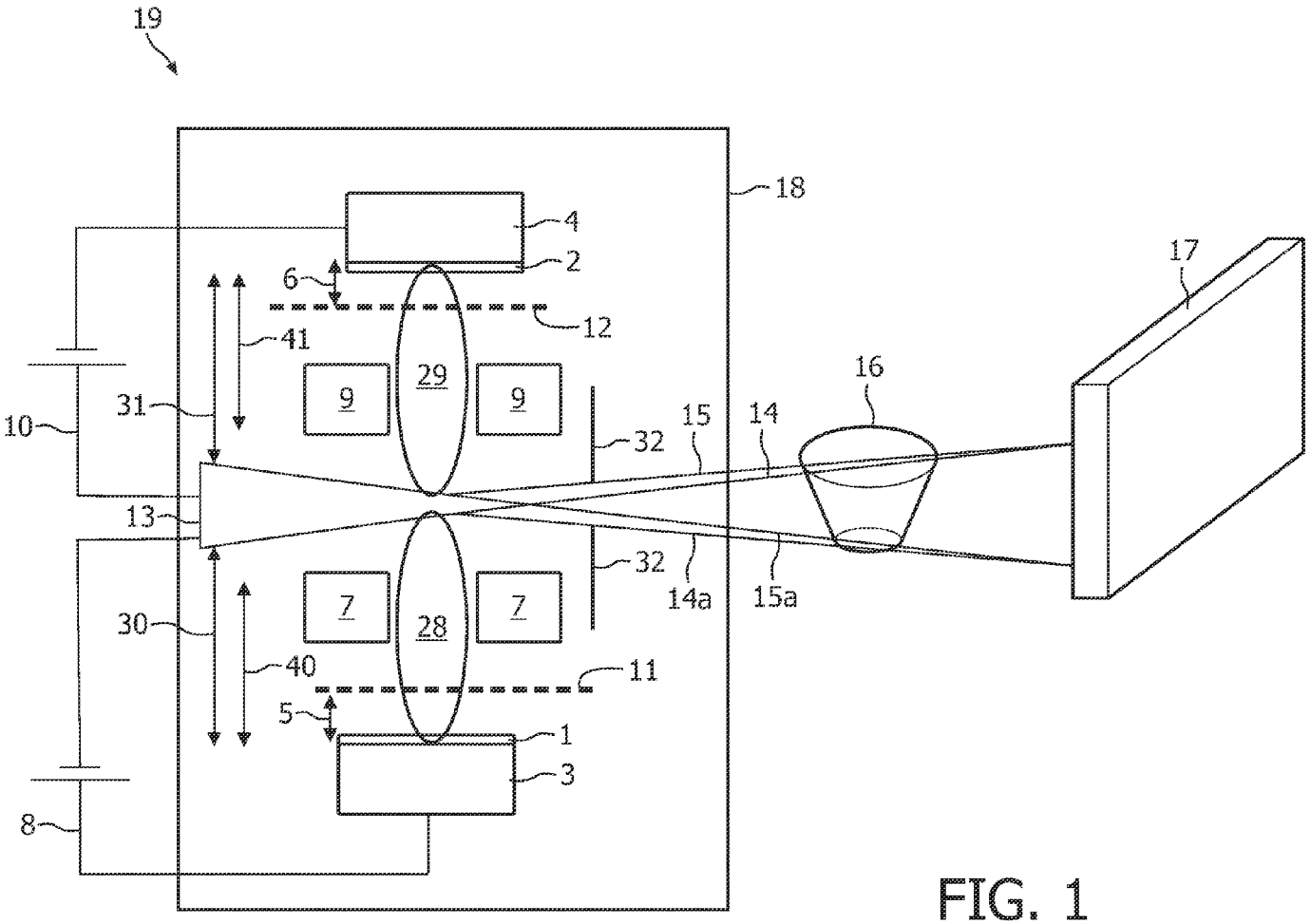
FIG. 1 shows a schematic X-ray source with two carbon nanotube according to an exemplary embodiment of the present invention.

Similar or relating components in the several figures are provided with the same reference numerals. The view in the figures is schematic and not fully scaled.

FIG. 1 shows an exemplary embodiment of the invention. An X-ray source 19 comprises a first cnt 1 on a first substrate 3 and a second cnt 2 on second substrate 4. The substrates may, for example, be microchips consisting of various different materials and layers, or the substrates may be made out of, for example, quartz, glass or silicon. The first gate voltage 5 is thereby applied between the first substrate 3 and the first gate 11 in order to emit electrons by field emission out of the first carbon nanotube 1, which may, as mentioned above, be a plurality or a bundle of cnts. The first acceleration voltage 30 is applied by the first voltage supply 8 between the first substrate 3 and the target 13, in order to accelerate the emitted electrons onto the target. The first acceleration voltage 30 may be applied independently from the first gate voltage 5. The first focusing voltage 40 may be applied between the substrate and the first focusing sub unit 7. The first focusing sub unit 7 deviates the accelerated, emitted first electrons 28 of the first carbon nanotube in such a way, that the first trajectory of the first X-ray beam with the upper boundary 14 and the lower boundary 14*a*, spatially overlaps with the second trajectory of the second X-ray beam having an upper boundary 15 and a lower boundary 15*a* at the object of interest. This overlap may be that exact, that a perfect reconstruction may be done, as if the two trajectories were having the same source position. In other words: the two beam cones shown in FIG. 1, limited by boundaries 14 and 14*a* and 15 and 15*a* respectively are illuminating the object of interest in such a nearly exact way, that the difference may not lead to artifacts in the process of reconstruction. Thereby the object of interest 16 is illuminated by both types of X-ray photons and a detecting screen or detector 17 converts the information of the transmitted signals into projection images. These images may be used to do the reconstruction. In order to further mechanically select the emission of the photons a collimator 32 made out of an X-ray absorbing material may be used. The collimator 32 is used as another instrument to further equal the two paths of the X-rays. Further on, a housing 18 is shown.

Furthermore a first, lower entity may comprise the first cnt 1, the first focusing sub unit 7, the first electrons 28 and the first gate voltage 5. A second, upper entity may comprise the second cnt 2, the second focusing sub unit 9, the second electrons 29 and the second gate voltage 6.

In the upper part of FIG. 1 the second entity for independent X-ray generation is shown, comprising the second focusing sub unit 9, the second voltage supply 10 to apply the second acceleration voltage 31 and comprising the second gate voltage 6. This gate voltage is thereby applied between the second gate 12 and the second substrate 4, to cause the electron emission of the second cnt 2. Thereby second electrons 29 are emitted and accelerated onto the target 13 by the second acceleration voltage 31.

Also other voltage supplies may be comprised by this exemplary embodiment of the invention like for example focusing voltage supplies or gate voltage supplies. The may be external and positioned out of the housing, but may also be integrated if desired into the one housing. Furthermore these other voltages may also be derived from the first and second voltage supplies.

A switching with external switch/control element between the first, lower entity with first cnt 1, first focusing sub unit 7, first electrons 28 and first gate voltage 5 and the second, upper entity with second cnt 2, second focusing sub unit 9, second electrons 29 and second gate voltage 6 may provide a dual kilovolt and dual energy imaging without having the need to use an energy resolving detector. Thereby additional information may be gathered and the X-ray burden to a patient as well as the operational costs may be lowered.

The on/off switching of the cnts could be much faster compared to the voltage modulation of a generator. This might lead to an improvement of the duration of time of an imaging process.

In other words two cnts located in a 180° position are operated with different voltages and they are switched on and off in an alternating-non overlapping way with high frequency. As the cnt has no "afterglow" because of the cold emitter the switching may be quite fast. The focusing units of both cnts are designed in a way that the beam through the object from the anode is more or less the same trajectory that could be used for the reconstruction. A voltage compensation and modified electrodes minimize the deviation of the beams.

In other words: different focus voltage and/or geometry are adjusted to compensate for the different target to object geometries which leads to same trajectories for reconstruction.

Another option is that both cnt elements are operated with different voltages from two different high voltage generators. Alternatively, one main generator (voltage 1) may supply cnt 1 and the voltage of main generator and the offset-voltage of a smaller auxiliary generator 2 (in sum equals voltage 2) may supply cnt 2.

Figure 2:
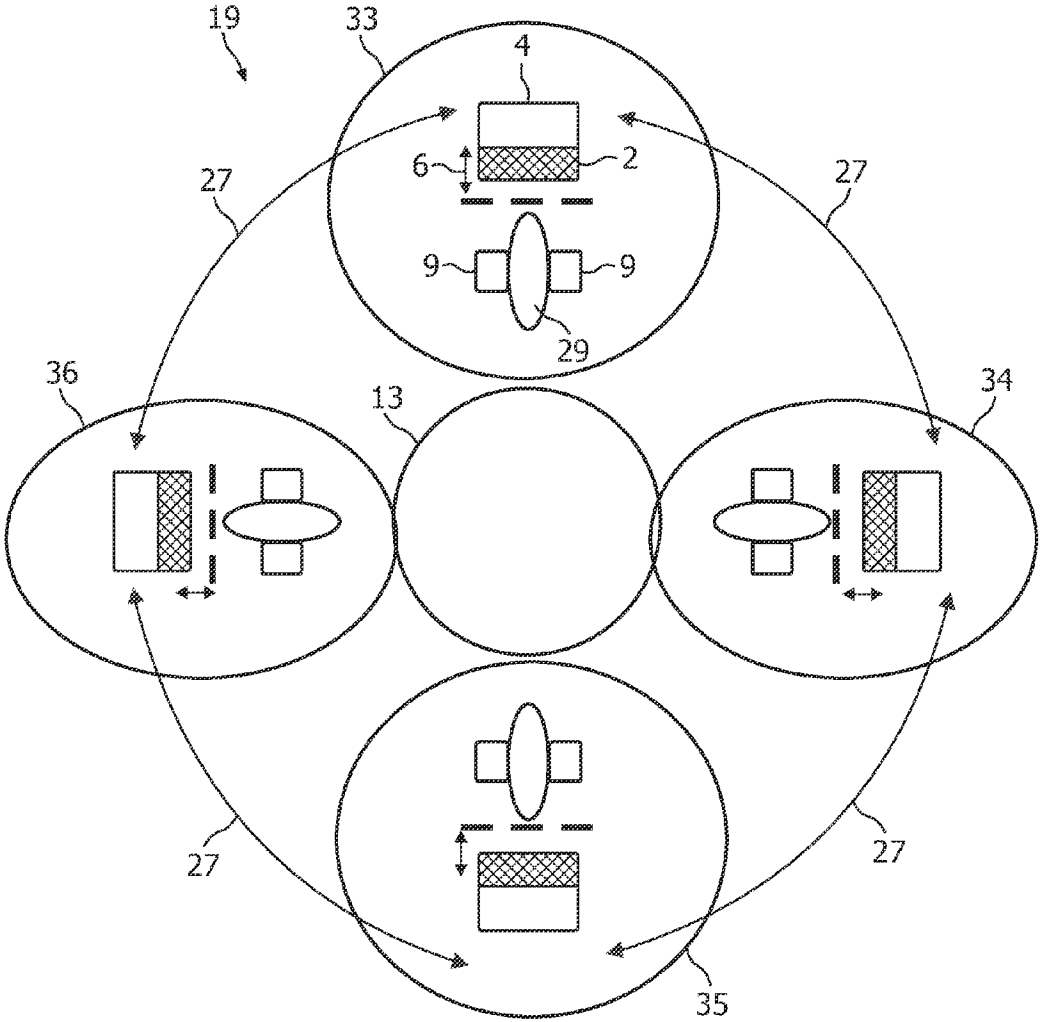
FIG. 2 shows a schematic X-ray source with four carbon nanotube according to an exemplary embodiment of the present invention.

FIG. 2 further shows another embodiment of the present invention, wherein an X-ray source 19 with an arrangement of four electron emitting cnts is shown. Thereby it is possible to switch between four different preadjusted energies of the X-ray photons, between four different adjusted focal spot geometries and/or between four different spatial resolutions. All these parameters are adjusted independently by the respective focusing voltages and the respective acceleration voltages as described above. Here four similar, but independent entities 33, 34, 35 and 36 are shown in a circular way around the target 13. They may also be placed along the arrows 27 indicating an area of possible continuously placed carbon nanotubes.

For CT and X-ray applications dual energy may be a promising technology to get additional information about the material properties of the scanned object.

All four cnt elements may be operated with different and independent voltages. The setup may be extended to a cone geometry of the anode and multiple emitters located in a circular geometry around the anode.

This source and method may also be used to switch between different focus geometries in a fast way from for example small to big focal spot but also the shape of the focal spot point could be modulated by switching the different cnt gates. A further option is to do a sequential scanning.

Figure 3:
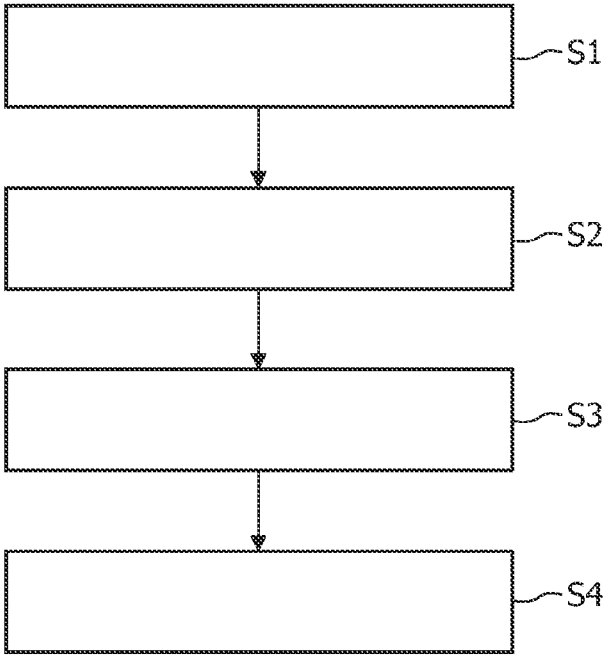
FIG. 3 shows schematically the steps of a method according an exemplary embodiment of the present invention.

FIG. 3 shows four steps of a method according to another exemplary embodiment of the invention. By providing a first and a second modus S1 and switching between the first and the second modus S2 the dual energy kV imaging may be provided. Further the first modus comprises focusing first electrons emitted by a first carbon nanotube onto a target to generate first X-ray photons having a first trajectory, and the second modus comprises focusing second electrons emitted by a second carbon nanotube onto a target to generate second X-ray photons having a second trajectory. Thereby, the focusing is performed in such a way, that the first and the second trajectories overlap before reaching the object of interest.

These steps, that may be induced by a user or software controlled computer, may be added by selecting a first acceleration voltage and a second acceleration voltage S3 and selecting a frequency of the switching between the first and the second modus by a user S4.

Further steps of the method may include the selection of different focusing voltages or different gate voltages.

Furthermore, all other steps, being necessary to realize a radiation source according to an above described embodiment are included herewith.

Figure 4:
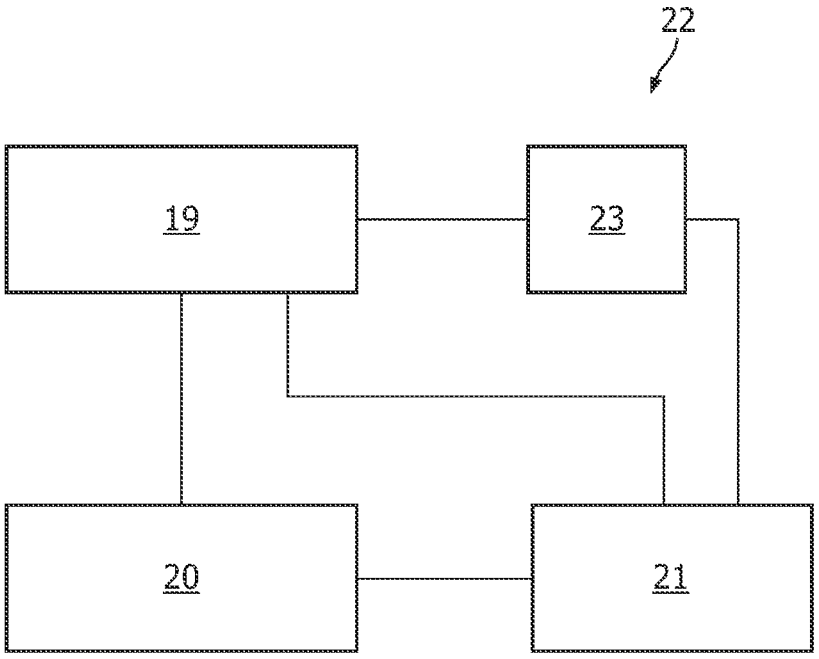
FIG. 4 shows a schematic representation of an examination apparatus according to an exemplary embodiment of the present invention.

FIG. 4 shows an examination apparatus 22 according to another exemplary embodiment of the invention. The examination apparatus 22 comprises an X-ray source 19 according to an exemplary embodiment of the invention described before or in the following, a user interface 20 for making user communication possible, a computer program element 21 for operating the steps of a described method and a working station or an imaging system 23. This imaging system may for example be an X-ray apparatus, a CT or for example a combination of an X ray apparatus with a positron emission tomography apparatus. Other imaging systems are possible. More specific exemplary embodiments may be seen in FIGS. 5 and 6. The connecting lines of these four elements shall be interpreted as interconnections between the different media.

Figure 5:
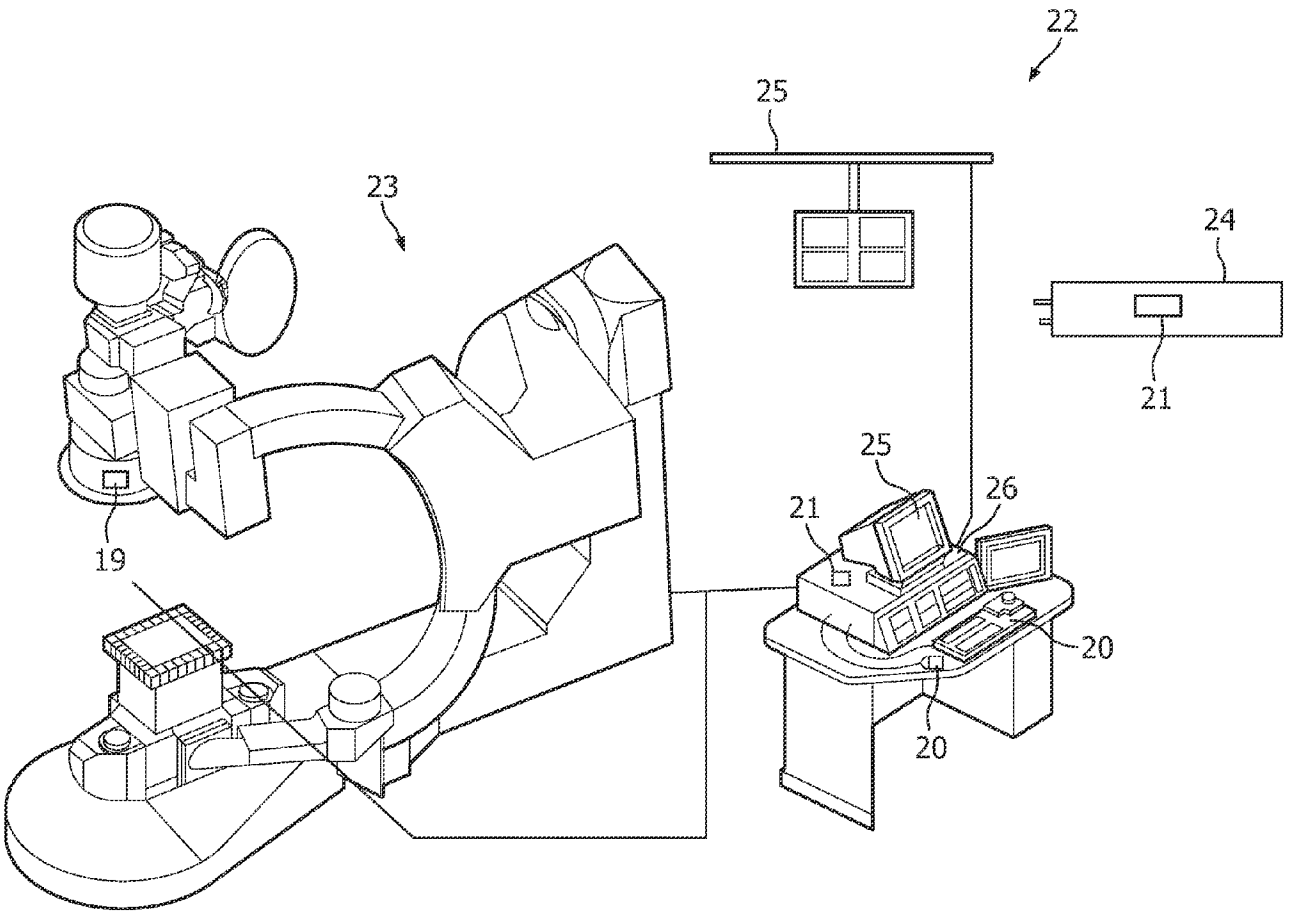
FIG. 5 shows a further schematic representation of an examination apparatus according to another exemplary embodiment of the present invention.

FIG. 5 shows another examination apparatus 22 according to another exemplary embodiment of the invention. An imaging system 23, here a C-arm shaped X-Ray apparatus with an integrated radiation source 19 according to another exemplary embodiment of the invention is presented. This system is linked to user interfaces 20. By means of these, a user may control and adjust the X-ray generation, propagation and examination process. Further on, a computer 26 with a computer program element 21 on it is presented. This program may automatically observe and operate the radiation source and the whole analyzing process. On different types of screens like a computer monitor, a LC display, a plasma screen or a video projector 25 the results of the X-ray detection and reconstruction may be shown to the user.

Figure 6:
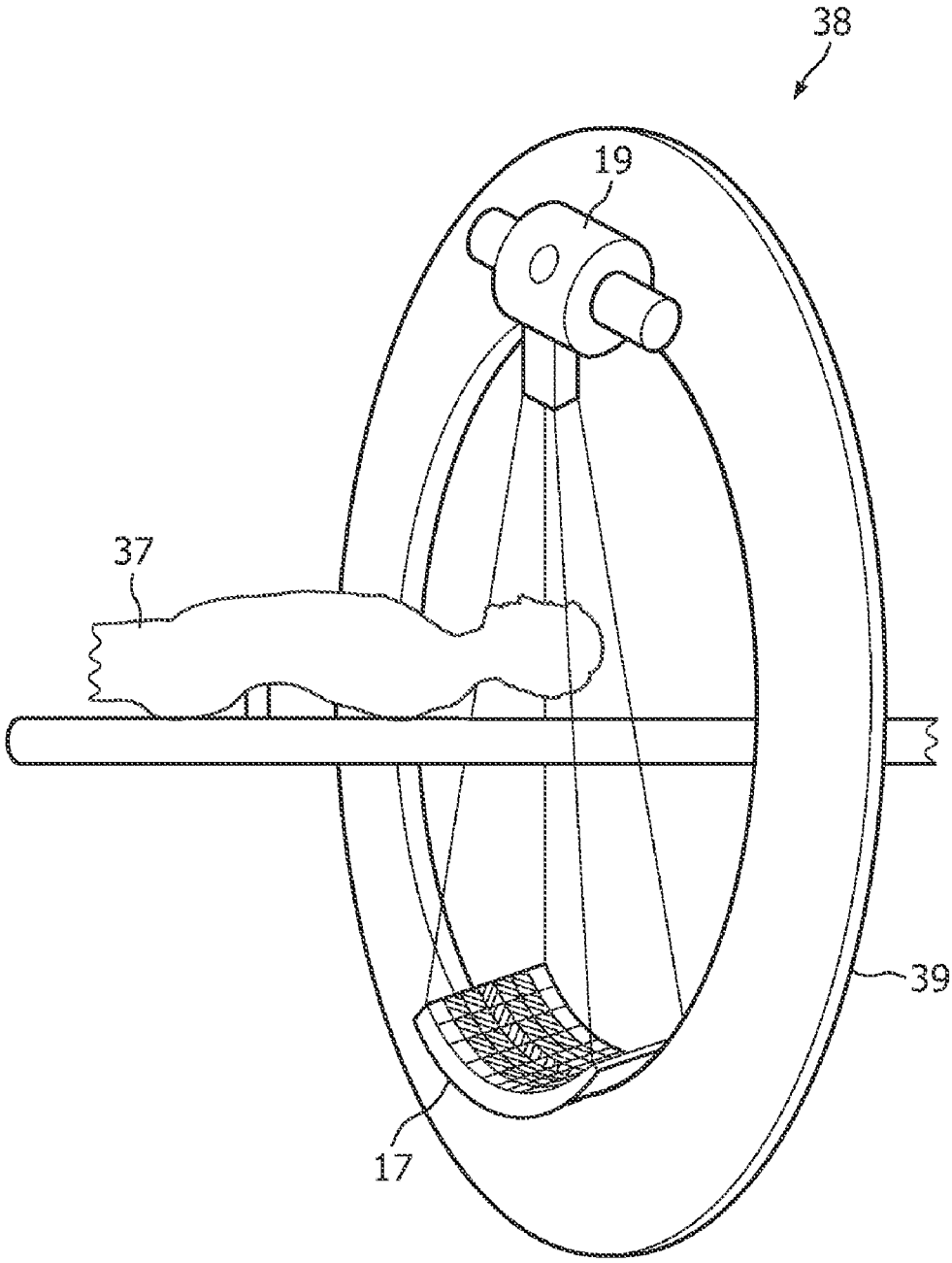
FIG. 6 shows a further schematic representation of an examination apparatus according to another exemplary embodiment of the present invention.

FIG. 6 shows another examination apparatus according to another exemplary embodiment of the invention. Instead of using a C arm shaped X-ray apparatus like shown in FIG. 5, it is also possible to use as imaging system for example a computer tomography apparatus 38. Thereby the apparatus comprises a radiation source 19 according to another embodiment of the invention. A patient 37 is illuminated with the generated X-ray beams, that are subsequently detected on a detector or a detecting screen 17.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items or steps recited in the claims. The mere fact that certain measures are recited in mutually different dependent claims does not indicate that a combination of these measures cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

REFERENCE NUMERALS

1 first carbon nanotube
2 second carbon nanotube
3 first substrate
4 second substrate
5 first gate voltage
6 second gate voltage
7 first focusing sub unit
8 first voltage supply
9 second focusing sub unit
10 second voltage supply
11 first gate
12 second gate
13 target
14 upper boundary of first trajectory
14*a* lower boundary of first trajectory
15 upper boundary of second trajectory
15*a* lower boundary of second trajectory
16 object of interest
17 detecting screen/detector
18 housing
19 X-ray source
20 user interface
21 computer program element
22 examination apparatus
23 working station/imaging system
24 computer readable medium
25 visualizing screen
26 computer
27 area of possible continuously placed carbon nanotubes
28 accelerated, emitted first electrons of the first carbon nanotube
29 accelerated, emitted second electrons of the second carbon nanotube
30 first acceleration voltage
31 second acceleration voltage
32 collimator
33, 34, 35, 36 independent entities
37 patient
38 computer tomography apparatus
39 tube or ring of computer tomography apparatus
40 first focusing voltage
41 second focusing voltage
S1 providing a first and a second modus;
S2 switching between the first and the second modus;
S3 selecting a first gate voltage and a second gate voltage by a user;
S4 selecting a frequency of the switching between the first and the second modus by a user.

The invention claimed is:

1. A radiation source for X-ray generation for examining an object of interest, the source comprising:

a first carbon nanotube for emitting first electrons in response to a first acceleration voltage applied to the first carbon nanotube and a second carbon nanotube for emitting second electrons in response to a second acceleration voltage applied to the second carbon nanotube, the second acceleration voltage being adjusted independently from the first acceleration voltage;

a target; and a focusing unit for focusing the first and the second electrons onto the target to generate first X-ray photons of a first energy having a first trajectory and second X-ray photons of a second energy having a second trajectory, wherein a difference between the first and second acceleration voltages enables a difference of energy between the first X-ray photons and the second X-ray photons, and wherein the focusing unit is adapted for being operated in such a way, that the first and the second trajectories overlap before reaching the object of interest.

2. The radiation source according to claim 1, wherein the focusing unit comprises two focusing sub units; and wherein the first sub unit is adapted for focusing the first electrons onto the target; and wherein the second sub unit is adapted for focusing the second electrons onto the target.

3. The radiation source according to claim 1, wherein the radiation source is adapted for switching between different focus geometries of the first and the second X-ray photons.

4. The radiation source according to claim 1, wherein the radiation source is adapted for switching between different energies of the first and the second X-ray photons.

5. The radiation source according to claim 1, wherein the radiation source is adapted for modulating a spatial resolution of the first and the second X-ray photons.

6. The radiation source according to claim 1, further comprising:

a housing;

wherein the first carbon nanotube, the second carbon nanotube and the focusing unit are integrated in the housing.

7. The radiation source according to claim 1, further comprising:

a plurality of carbon nanotubes;

wherein each carbon nanotube is adapted for emitting electrons;

wherein all carbon nanotubes are located in a geometry around the target;

wherein the focusing unit is adapted for focusing the emitted electrons of each carbon nanotube onto the target to generate corresponding X-ray photons with respective trajectories; and wherein the focusing unit is adapted for being operated in such a way, that all trajectories overlap before reaching the object of interest.

8. An examination apparatus for the examination of an object of interest, the examination apparatus comprising a radiation source of claim 1.

9. An examination apparatus for the examination of an object of interest, the examination apparatus comprising:

a radiation source for X-ray generation that comprises a first carbon nanotube for emitting first electrons and a second carbon nanotube for emitting second electrons, a target, and a focusing unit for focusing the first and the second electrons onto the target to generate first X-ray photons having a first trajectory and second X-ray photons having a second trajectory, wherein the focusing unit is adapted for being operated in such a way, that the first and the second trajectories overlap before reaching the object of interest; and a first and a second voltage supply;

wherein the first voltage supply is arranged to apply a first acceleration voltage to the first carbon nanotube and the second voltage supply is arranged to apply a second acceleration voltage to the second carbon nanotube; and wherein a difference between the first and the second acceleration voltages leads to a difference of energy between the first and the second X-ray photons.

10. A method for X-ray generation for examination of an object of interest, the method comprising the steps of:

providing a first and a second modus; and switching between the first and the second modus;

wherein the first modus comprises focusing first electrons emitted by a first carbon nanotube, in response to a first acceleration voltage applied to the first carbon nanotube, onto a target to generate first X-ray photons of a first energy having a first trajectory;

wherein the second modus comprises focusing second electrons emitted by a second carbon nanotube, in response to a second acceleration voltage applied to the second carbon nanotube, onto a target to generate second X-ray photons of a second energy having a second trajectory, wherein a difference between the first and second acceleration voltages enables a difference of energy between the first X-ray photons and the second X-ray photons; and wherein the focusing is performed in such a way, that the first and the second trajectories overlap before reaching the object of interest.

11. A method for X-ray generation for examination of an object of interest, the method comprising the steps of:

providing a first and second modus; and switching between the first and second modus;

wherein the first modus comprises focusing first electrons emitted by a first carbon nanotube onto a target to generate first X-ray photons having a first trajectory;

wherein the second modus comprises focusing second electrons emitted by a second carbon nanotube onto a target to generate second X-ray photons having a second trajectory;

wherein the focusing is performed in such a way, that the first and the second trajectories overlap before reaching the object of interest; the method further comprising:

selecting a first acceleration voltage and a second acceleration voltage by a user; and selecting a frequency of the switching between the first and the second modus by the user;

wherein the first acceleration voltage is applied to the first carbon nanotube and the second acceleration voltage is applied to the second carbon nanotube.

12. A non-transitory computer readable medium embodied with a computer program being adapted, when in use on a computer, to cause the computer to perform the steps of the method according to claim 10.

* * * * *